US008009185B2

(12) United States Patent
Sako

(10) Patent No.: US 8,009,185 B2
(45) Date of Patent: Aug. 30, 2011

(54) THERMAL HEAD WITH PROTECTIVE LAYER

(75) Inventor: Teruhisa Sako, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 916 days.

(21) Appl. No.: 11/629,581

(22) PCT Filed: Jun. 13, 2005

(86) PCT No.: PCT/JP2005/010784

§ 371 (c)(1),
(2), (4) Date: Dec. 14, 2006

(87) PCT Pub. No.: WO2005/123400

PCT Pub. Date: Dec. 29, 2005

(65) Prior Publication Data

US 2009/0102910 A1 Apr. 23, 2009

(51) Int. Cl.
*B41J 2/335* (2006.01)
*H05B 3/00* (2006.01)

(52) U.S. Cl. ..... 347/203; 29/611

(58) Field of Classification Search ..... 347/203, 347/208, 202, 204; 29/611
See application file for complete search history.

(56) References Cited

U.S. PATENT DOCUMENTS

| | | | | |
|---|---|---|---|---|
| 4,612,433 | A * | 9/1986 | Nagaoka et al. | 347/202 |
| 4,835,550 | A | 5/1989 | Sato et al. | |
| 6,236,423 | B1 | 5/2001 | Yamaji | |
| 6,441,840 | B1 * | 8/2002 | Sato et al. | 347/208 |
| 6,483,528 | B1 * | 11/2002 | Yamade et al. | 347/203 |
| 2007/0211133 | A1 * | 9/2007 | Sako | 347/204 |
| 2009/0174757 | A1 * | 7/2009 | Sako et al. | 347/203 |

FOREIGN PATENT DOCUMENTS

| | | |
|---|---|---|
| JP | 63-74658 | 4/1988 |
| JP | 63-216760 | 9/1988 |
| JP | 2-150365 | 6/1990 |
| JP | 8267810 | * 10/1996 |
| JP | 10-244698 | 9/1998 |
| JP | 10244698 | * 9/1998 |
| JP | 2001-47652 | 2/2001 |

OTHER PUBLICATIONS

International Search Report for corresponding International Application PCT/JP2005/010784, mailed Sep. 13, 2005.

* cited by examiner

*Primary Examiner* — Stephen Meier
*Assistant Examiner* — Carlos A Martinez
(74) *Attorney, Agent, or Firm* — Hamre, Schumann, Mueller & Larson, P.C.

(57) ABSTRACT

A thermal head (A) according to the present invention includes a substrate (1) on which a heat-producing resistor (5), a common electrode (3) and individual electrodes (4) for energizing the heat-producing resistor (5), and a protective layer (6) having a double-layer structure and formed on the heat-producing resistor (5) to cover at least the heat-producing resistor are provided. A second protective layer (6B) constituting the upper layer of the protective layer (6) is conductive, and a first protective layer (6A) constituting the lower layer of the protective layer (6) has thickness (t1) which is not less than three times the thickness (t2) of the second protective layer (6B).

16 Claims, 5 Drawing Sheets

THERMAL HEAD WITH PROTECTIVE LAYER

TECHNICAL FIELD

The present invention relates to a thermal head used as a structural part of a thermal printer, and also relates to a manufacturing method thereof.

BACKGROUND ART

FIG. 7 shows a conventional thermal head. The thermal head B includes an insulating substrate 91, and a glaze layer 92 made of e.g. glass and formed on the substrate. An electrode 93 and a heat-producing resistor 95 are formed on the glaze layer 92. A protective layer 96 for covering the heat-producing resistor 95 and the electrode 93 are formed by printing and baking amorphous glass.

To perform printing using the thermal head B, a platen roller P is arranged to face the heat-producing resistor 95. In printing, with thermal recording paper S as the printing medium pressed against the protective layer 96 by the platen roller P, the thermal recording paper S is moved in a secondary scanning direction through a distance corresponding to one line, for example. Then, the heat generated at the heat-producing resistor 95 is transferred to the thermal recording paper S via the protective layer 96 to change the color of the paper at that portion, whereby printing is performed. Thereafter, by alternately repeating the movement of the recording paper S line by line and the printing process by the thermal head B, printing is performed with respect to the entire recording paper S.

In the printing process using a thermal head, the so-called sticking may occur. The sticking is a phenomenon that the thermal recording paper adheres to the obverse surface of the protective layer so that the transfer of the thermal recording paper becomes irregular. Due to the sticking, a print failure such as the appearance of a white line on the thermal recording paper may occur.

As a method to prevent the sticking, it may be considered to reduce the frictional resistance between the thermal recording paper and the protective layer by smoothing the obverse surface of the protective layer. Therefore, in the conventional thermal head B, the protective layer 96 to be pressed against the recording paper in the printing process is made of amorphous glass to suppress the sticking, because amorphous glass is excellent in smoothness of the surface.

FIG. 8 shows another example of conventional thermal head which utilizes amorphous glass to suppress the sticking. As shown in the figure, this thermal head includes a protective layer 96 having a double-layer structure comprising the lamination of different kinds of layers, i.e., a first protective layer 96A and a second protective layer 96B. In this thermal head B', of the two layers, the first protective layer 96A which is on the lower side is made of crystallized glass having excellent wear resistance, whereas the second protective layer 96B on the upper side is made of amorphous glass having excellent smoothness. In this way, in the thermal head B' shown in FIG. 8, the first protective layer 96A having excellent wear resistance is provided under the second protective layer 96B to be pressed against the recording paper S. Therefore, the wear resistance of the thermal head is enhanced as compared with the thermal head B shown in FIG. 7.

In the printing process using a thermal head, the adhesive force of the thermal recording paper to the protective layer is relatively large, because the thermal recording paper is pressed against the protective layer during when it is transferred. Further, the component of the protective layer or of the thermal recording paper may soften due to the heat produced at the heat-producing resistor. In such a case, the adhesive force further increases.

The removal of the thermal recording paper from the protective layer can be facilitated by smoothing the obverse surface of the protective layer and reducing the frictional resistance to as small as possible. However, even when the frictional resistance at the obverse surface of the protective layer is reduced, the recording paper may not be reliably removed from the protective layer in the case where the recording paper adheres to the protective layer not only due to the pressing force by the platen roller but also due to the softening of the component of the protective layer or of the thermal recording paper caused by the heat production at the heat-producing resistor. Therefore, the sticking cannot be sufficiently prevented by the conventional thermal heads B and B' in which only smoothing of the obverse surface is attempted by making the protective layer 96 or the second protective layer 96B to be pressed against the thermal recording paper by utilizing amorphous glass.

As another method to prevent sticking, it may be considered to reduce the pressing force for pressing the thermal recording paper to the protective layer. According to this method, however, heat cannot be sufficiently transferred to the thermal recording paper, which may cause problems such as degradation of printing quality.

Patent Document 1: JP-A-S63-74658

Patent Document 2: JP-A-2001-47652

DISCLOSURE OF THE INVENTION

The present invention is conceived under the above-described circumstances. It is, therefore, an object of the present invention to provide a thermal head which is capable of preventing the sticking and improving the printing quality.

According to a first aspect of the present invention, there is provided a thermal head comprising a substrate on which a heat-producing resistor, an electrode for energizing the heat-producing resistor and a protective layer having a double-layer structure and covering at least the heat-producing resistor are provided. A second protective layer constituting the upper layer of the protective layer is conductive, and a first protective layer constituting the lower layer of the protective layer has a thickness of not less than three times the thickness of the second protective layer.

Preferably the thickness of the first protective layer is 2 to 13 μm.

According to a second aspect of the present invention, there is provided a method for manufacturing the thermal head as set forth in claim 1. In this method, the first protective layer is formed by baking glass, whereas the second protective layer is formed by baking glass containing a conductive component added thereto at a baking temperature which is lower than the softening temperature of the glass of the first protective layer.

According to a third aspect of the present invention, there is provided a method for manufacturing the thermal head as set forth in claim 1. In this method, the first protective layer is formed by baking amorphous glass, whereas the second protective layer is formed by baking crystallized glass containing a conductive component added thereto at a baking temperature which lies in the range of 30 degrees lower and 50 degrees higher than the softening temperature of the crystallized glass.

Preferably the softening temperature of the amorphous glass for forming the first protective layer is lower than the baking temperature of the second protective layer by not less than 50 degrees.

Preferably the softening temperature of the amorphous glass for forming the first protective layer is lower than the softening temperature of the crystallized glass by not less than 50 degrees.

Preferably the baking temperature of the first protective layer is substantially equal to the baking temperature of the second protective layer.

According to a fourth aspect of the present invention, there is provided a method for manufacturing a thermal head comprising a substrate on which a heat-producing resistor, an electrode for energizing the heat-producing resistor and a protective layer having a double-layer structure and covering at least the heat-producing resistor are provided. In this method, a first protective layer constituting the lower layer of the protective layer is formed by baking amorphous glass, and a second protective layer constituting the upper layer of the protective layer is formed by baking crystallized glass at a baking temperature which lies in a range of 30 degrees lower and 50 degrees higher than the softening temperature of the crystallized glass.

Preferably the softening temperature of the amorphous glass for forming the first protective layer is lower than the baking temperature of the second protective layer by not less than 50 degrees.

Preferably the softening temperature of the amorphous glass is lower than the softening temperature of the crystallized glass by not less than 50 degrees.

Preferably the baking temperature of the first protective layer is substantially equal to the baking temperature of the second protective layer.

The thermal head according to a fourth aspect of the present invention is manufactured by a manufacturing method as set forth in any one of claims 8 to 10.

BEST MODE FOR CARRYING OUT THE INVENTION

Preferred embodiments of the present invention will be described below with reference to the accompanying drawings.

Figure 1:
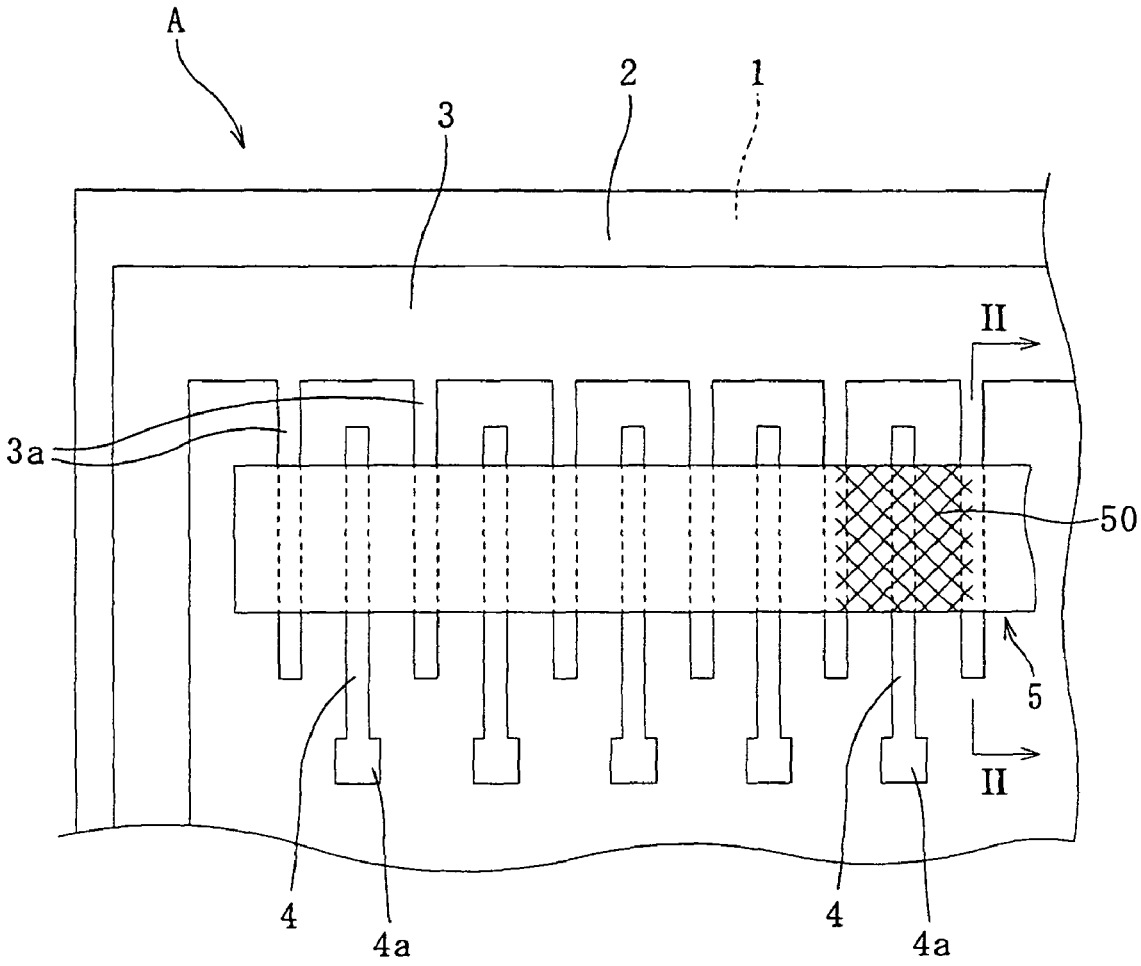
FIG. 1 is a plan view showing a principal portion of a thermal head according to the present invention.
Figure 2:
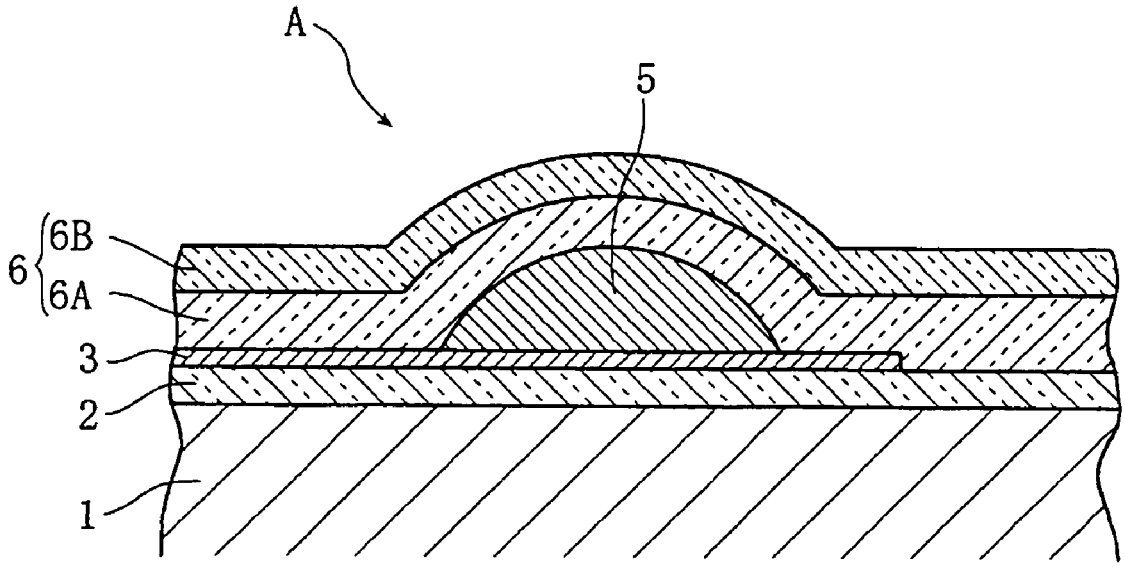
FIG. 2 is a sectional view taken along lines II-II in FIG. 1.

FIGS. 1 and 2 show an example of thermal head according to the present invention. The thermal head A according to the first embodiment includes a substrate 1, a glaze layer 2, a common electrode 3, a plurality of individual electrodes 4, a heat-producing resistor 5 and a protective layer 6. In FIG. 1, the illustration of the protective layer 6 is omitted.

The substrate 1 is insulative and made of alumina ceramic, for example. The glaze layer 2 serves as a heat retaining layer and also serves to smooth the surface on which the common electrode 3 and the individual electrodes 4 are to be mounted to enhance the adhesion of the electrodes. The glaze layer 2 is formed on almost entirety of the obverse surface of the substrate 1 by printing and baking glass paste.

The common electrode 3 includes a plurality of extensions 3*a* projecting like the teeth of a comb. Each of the individual electrodes 4 is so arranged that one end thereof is positioned between adjacent extensions 3*a*. The other end of each individual electrode 4 is formed with a bonding pad 4*a*. Each of the bonding pads 4*a* is electrically connected to an output pad of a non-illustrated drive IC. The common electrode 3 and the individual electrodes 4 are formed by printing and baking gold resinate paste, for example.

The heat-producing resistor 5 is in the form of a strip having a constant width and extending in one direction of the substrate 1 continuously across the extensions 3*a* and the individual electrodes 4. The heat-producing resistor 5 may be formed by printing and baking ruthenium oxide paste, for example.

When current is applied selectively to the individual electrodes 4 by the non-illustrated drive IC, the region 50 (e.g. crosshatched portion in FIG. 1) of the heat-producing resistor 5 which is sandwiched between adjacent extensions 3*a* produces heat to form a single heat-producing dot.

The protective layer 6 is provided to cover the surfaces of the common electrode 3, the individual electrodes 4 and the heat-producing resistor 5. The protective layer 6 has a double layer structure consisting of a first protective layer 6A made of amorphous glass and a second protective layer 6B made of crystallized glass. The second protective layer 6B is a porous layer formed to cover the first protective layer 6A.

An example of thermal head manufacturing method according to the present invention will be described below with reference to FIGS. 3-5.

Figure 3:
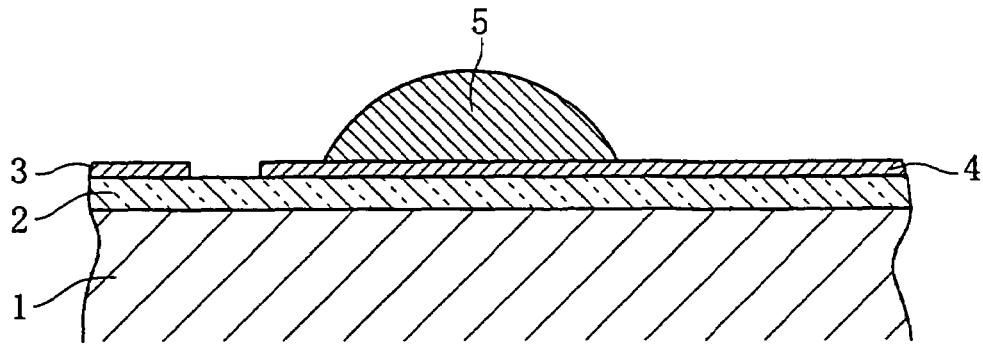
FIG. 3 is a sectional view of a principal portion showing a method for manufacturing a thermal head according to the present invention.

FIG. 3 is a sectional view showing a principal portion of a substrate 1 on which a glaze layer 2, a common electrode 3, individual electrodes 4 and a heat-producing resistor 5 are formed. First, as shown in FIG. 3, the substrate 1 on which a glaze layer 2, a common electrode 3, individual electrodes 4 and a heat-producing resistor 5 are formed in a laminated manner is prepared. Specifically, the glaze layer 2 is formed by printing and baking glass paste. The common electrode 3 and the individual electrodes 4 are formed by printing and baking gold resinate paste and etching away unnecessary portions by photolithography, for example. The heat-producing resistor 5 is formed by printing and baking ruthenium oxide paste, for example.

Figure 4:
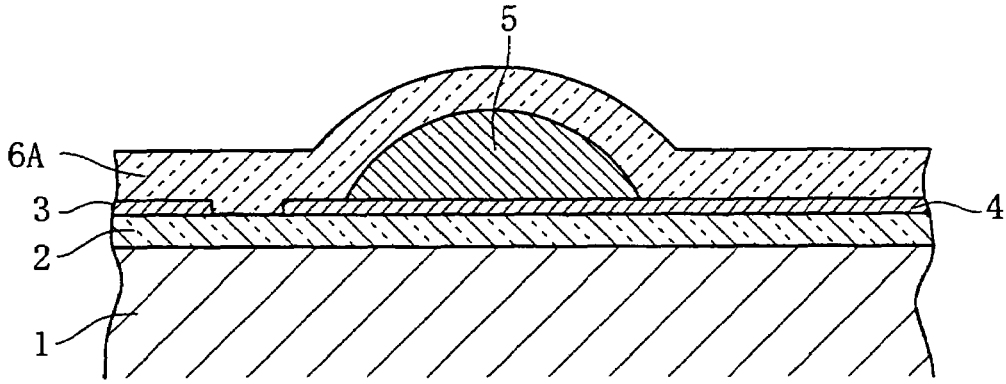
FIG. 4 is a sectional view of a principal portion showing a method for manufacturing a thermal head according to the present invention.

Subsequently, as shown in FIG. 4, a first protective layer 6A is formed to cover the common electrode 3, the individual electrodes 4 and the heat-producing resistor 5. The first protective layer 6A is formed by printing and baking amorphous glass paste containing $SiO_2$, $B_2O_3$ and PbO as the main ingredients.

The softening temperature of the above-described amorphous glass is 680° C. The baking temperature for forming the first protective layer 6A (hereinafter referred to as "first baking temperature") is 760° C. Since the first baking temperature (760° C.) is 80 degrees higher than the softening temperature (680° C.) of the amorphous glass, the viscosity of the amorphous glass reduces and the flowability increases sufficiently in the baking process. Therefore, bubbles contained in the amorphous glass disappear, so that the first protective layer 6A with high sealing performance can be obtained.

Figure 5:
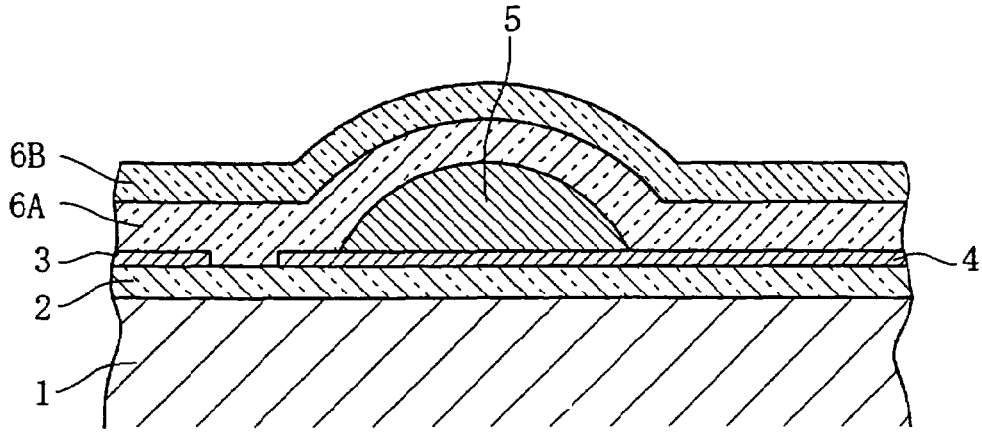
FIG. 5 is a sectional view of a principal portion showing a method for manufacturing a thermal head according to the present invention.

Subsequently, as shown in FIG. 5, a second protective layer 6B is formed on the first protective layer 6A. The second protective layer 6B is formed by printing and baking crystallized glass paste containing $SiO_2$, ZnO and CaO as the main ingredients.

The softening temperature of the above-described crystallized glass is 785° C. The baking temperature for forming the second protective layer 6B (hereinafter referred to as "second baking temperature") is 760° C. The second protective layer 6B is made of crystallized glass, and the second baking temperature (760° C.) is close to the softening temperature (785° C.) of the crystallized glass. In the baking process, the flow of the crystallized glass is suppressed by the crystal components, so that bubbles contained in the crystallized glass remain and become pores. As a result, the second protective layer 6B is obtained as a porous layer including a large number of pores.

Since the softening temperature (680° C.) of the amorphous glass forming the first protective layer 6A is 80 degrees lower than the second baking temperature (760° C.), the first protective layer 6A sufficiently softens to enhance its adhesion to the second protective layer 6B in baking the second protective layer 6B. Moreover, according to the first embodiment, the first baking temperature and the second baking temperature are substantially equal to each other, so that it is unnecessary to change the baking temperature in forming the first protective layer 6A and the second protective layer 6B.

In this manufacturing method, the second baking temperature is 25 degrees lower than the softening temperature of the crystallized glass for forming the second protective layer 6B. Therefore, in baking the second protective layer 6B, the flow of the entire glass is suppressed by the crystal components, and the viscosity of the crystallized glass reduces. Therefore, the second protective layer 6B is obtained as a porous layer in which the size and distribution of the pores are generally uniform through the entirety of the layer. It is to be noted that, to make the second protective layer 6B porous, the second baking temperature should lie in the range of 30 degrees lower and 50 degrees higher than the softening temperature of the crystallized glass.

Since the second protective layer 6B is porous, the obverse surface of the second protective layer 6B is more irregular than that of the second protective layer 96B of the conventional thermal head B'. Therefore, as compared with the conventional thermal head B', the thermal recording paper brought into close contact with the thermal head A in the printing process can be removed from the thermal head more easily, so that the sticking can be reliably prevented. Since the second protective layer 6B is porous, the irregularity of the obverse surface of the second protective layer 6B can be maintained even when the surface is slightly worn out due to the sliding contact with the thermal recording paper during the printing process. Therefore, the effect of the prevention of sticking can be properly maintained.

According to the above-described manufacturing method, the obverse surface of the second protective layer 6B becomes irregular due to the baking process of the layer. Therefore, another process, such as sandblasting, for making the obverse surface of the second protective layer 6B irregular does not need to be additionally performed after the layer is formed. Therefore, the thermal head A can be obtained by the process steps similar to those of the conventional manufacturing method. Therefore, according to the above-described manufacturing method, an increase in the manufacturing cost can be avoided. Since the sticking can be properly prevented by the manufacturing method, it is not necessary to reduce the force for pressing the thermal recording paper against the protective layer 6 during the printing process, so that the printing quality is not degraded.

In the first embodiment, the softening temperature of the amorphous glass for forming the first protective layer 6A is lower than the second baking temperature by not less than 50 degrees. In such a case, the first protective layer 6A sufficiently softens in baking the second protective layer 6B. Therefore, the adhesion between the first protective layer 6A and the second protective layer 6B is enhanced. As a result, the separation of the second protective layer 6B from the first protective layer 6A in the printing process can be prevented, whereby the durability of the thermal head A is enhanced.

In the first embodiment, the softening temperature of the amorphous glass for forming the first protective layer 6A is lower than the softening temperature of the crystallized glass for forming the second protective layer 6B by not less than 50 degrees. In such a case, the first protective layer 6A softens sufficiently in baking the second protective layer 6B even when the second baking temperature is set to a temperature not higher than the softening temperature of the second protective layer 6B. Therefore, the adhesion between the first protective layer 6A and the second protective layer 6B can be enhanced while suppressing the manufacturing cost by setting the second baking temperature relatively low.

According to the first embodiment, since the first baking temperature and the second baking temperature are substantially equal to each other, the temperature control in the manufacturing process can be facilitated, so that the productivity of the thermal head A is enhanced.

In the present invention, as the amorphous glass for forming the first protective layer and the crystallized glass for forming the second protective layer, glass materials having different composition or characteristic values from those described above may be used. Further, the first and the second baking temperatures can be changed appropriately in accordance with the selected amorphous glass or crystallized glass.

In the printing process using a thermal head, the thermal recording paper is moved, with the protective layer of the thermal head pressed against the thermal recording paper. Generally, therefore, static electricity builds up due to the contact friction between the protective layer and the thermal recording paper. The static electricity also increases the adhesion between the thermal head and the thermal recording paper, and has an adverse effect on the prevention of sticking.

In a conventional thermal head including a protective layer of a double-layer structure, to prevent the build up of static electricity between the protective layer and the thermal recording paper, the first protective layer on the lower side is made of an insulating material, whereas the second protective layer on the upper side is made of a conductive material. In such a thermal head, the heat producing resistor is prevented from being damaged due to the discharge of static electricity from the protective layer and becoming unable to produce heat. Further, the adverse effect on the prevention of sticking is lessened.

In this way, in the case where the protective layer of the thermal head is designed to have a double-layer structure, it is preferable to make the first protective layer on the lower side as an insulating layer and the second protective layer on the upper side as a conductive layer. However, in forming the second protective layer having conductivity on the first protective layer which is insulative, the first protective layer softens so that the conductive component of the second protective layer may diffuse into the first protective layer on the lower side. When such diffusion of the conductive component occurs, bubbles existed around the conductive component also diffuse, so that the sealing performance for sealing the heat-producing resistor is degraded. Therefore, the deterioration of the heat-producing resistor is promoted so that the life of the thermal head is shortened.

Therefore, in the following thermal head as another embodiment of the present invention, the degradation of the sealing performance due to the diffusion of the conductive component from the second protective layer 6B (upper layer) into the first protective layer 6A (lower layer) is prevented to prolong the life of the thermal head.

Figure 6:
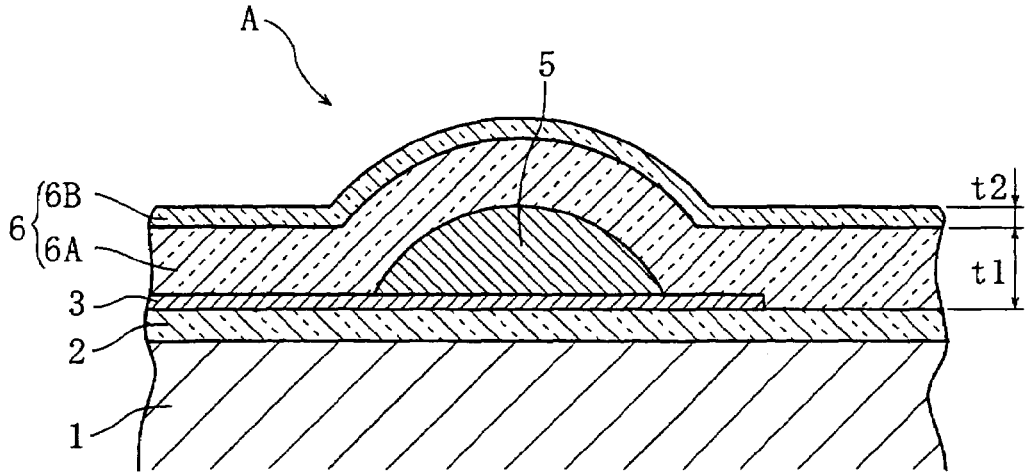
FIG. 6 is a plan view showing a principal portion of another thermal head according to the present invention.
Figure 7:
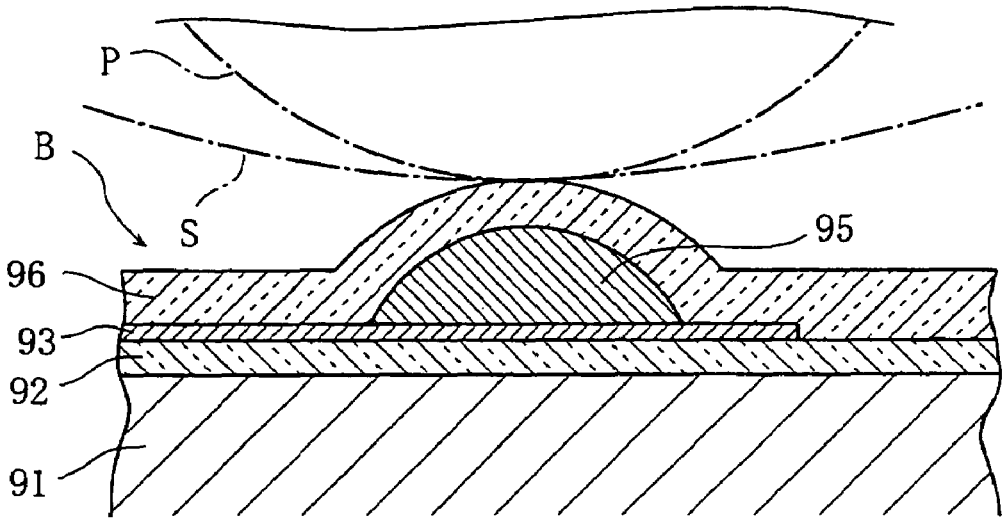
FIG. 7 Prior Art
FIG. 7 is a sectional view showing a principal portion of a conventional thermal head.
Figure 8:
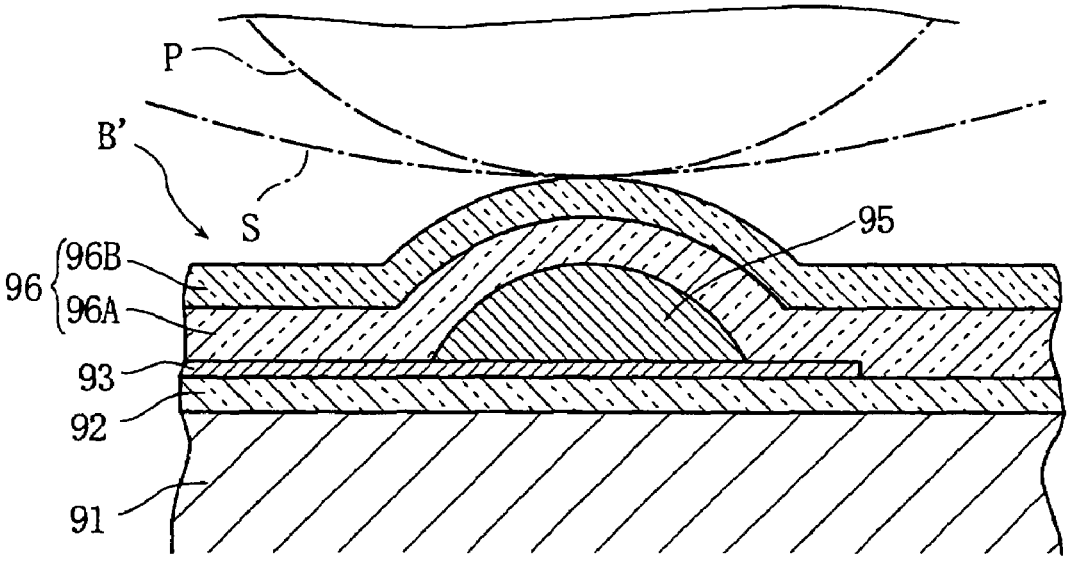
FIG. 8 Prior Art
FIG. 8 is a sectional view showing a principal portion of another conventional thermal head.

FIG. 6 shows the thermal head according to the present invention.

The protective layer 6 according to the second embodiment has a double layer structure made up of a first protective layer 6A and a second protective layer 6B which is conductive. The thickness t1 of the first protective layer 6A is not less than three times the thickness t2 of the second protective layer 6B. For instance, the thickness t1 may be 7 μm, whereas the thickness t2 may be 2 μm.

A method for manufacturing this thermal head will be described below. Since this manufacturing method is similar to the method for manufacturing the thermal head in which the first protective layer 6A is made of amorphous glass and the second protective layer 6B is made of crystallized glass, this method will be described with reference to FIGS. 3-5 again. In referring to FIG. 5, it is assumed that the thickness of the second protective layer 6B is not more than one third of the thickness of the first protective layer 6A.

First, as shown in FIG. 3, a substrate 1 on which a glaze layer 2, a common electrode 3, individual electrodes 4 and a heat-producing resistor 5 are formed in a laminated manner is prepared.

Subsequently, as shown in FIG. 4, a first protective layer 6A is formed to cover the common electrode 3, the individual electrodes 4 and the heat-producing resistor 5. The first protective layer 6A is formed by printing and baking amorphous glass paste containing $SiO_2$ and PbO as the main ingredients. For instance, the softening temperature of the amorphous glass is 745° C. For instance, the baking temperature for forming the first protective layer 6A (hereinafter referred to as "baking temperature of the first protective layer 6A") is 800° C.

Since the baking temperature of the first protective layer 6A (800° C.) is 55 degrees higher than the softening temperature (745° C.) of the amorphous glass, the viscosity of the amorphous glass reduces and the flowability increases sufficiently in the baking process. As a result, bubbles contained in the amorphous glass disappear, so that a first protective layer 6A with high sealing performance can be obtained.

Subsequently, as shown in FIG. 5, a second protective layer 6B is formed on the first protective layer 6A. The second protective layer 6B is formed by printing and baking conductive glass paste obtained by adding a conductive component such as ruthenium oxide to amorphous glass containing PbO, $B_2O_3$ and $SiO_2$ as the main ingredients.

For instance, the softening temperature of the amorphous glass for forming the second protective layer 6B is 590° C. For instance, the baking temperature for forming the second protective layer 6B (hereinafter referred to as "baking temperature of the second protective layer 6B") is 680° C. The baking temperature (680° C.) of the second protective layer 6B is 65 degrees lower than the softening temperature (745° C.) of the amorphous glass forming the first protective layer 6A. Therefore, in baking the second protective layer 6B, the first protective layer 6A hardly softens, so that the diffusion of the conductive component contained in the second protective layer 6B into the first protective layer 6A is efficiently prevented. As a result, deterioration of the sealing performance for sealing the heat-producing resistor 5 is prevented. Therefore, the expected functions of the first protective layer 6A, i.e., the insulation and protection of the heat-producing resistor 5 can be maintained, so that the life of the thermal head A can be prolonged.

Since the baking temperature of the second protective layer 6B is 90 degrees higher than the softening temperature (590° C.) of the amorphous glass for forming the second protective layer 6B, the second protective layer 6B softens sufficiently in the baking process, whereby the adhesion of the second protective layer 6B to the first protective layer 6A is enhanced.

In the thermal head A according to the second embodiment, the thickness t1 of the first protective layer 6A is sufficiently larger than the thickness t2 of the second protective layer 6B, i.e., not less than three times the thickness t2. Therefore, even when the conductive component diffuses into the first protective layer 6A in forming the second protective layer 6B, such diffusion hardly affects on the sealing performance for the heat-producing resistor 5.

Specifically, when the baking temperature of the second protective layer 6B is higher than the softening temperature of the glass for forming the first protective layer 6A unlike the above-described method, the first protective layer 6A softens and the flowability increases in baking the second protective layer 6B. As a result, the conductive component contained in the second protective layer 6B may diffuse into the first protective layer 6A by passing through the boundary between the second protective layer 6B and the first protective layer 6A. Even in such a case, the diffusion of the conductive component stops in an upper portion of the first protective layer 6A, and the conductive component does not diffuse into most part of the first protective layer 6A except for the upper portion, because the thickness t1 of the first protective layer 6A is sufficiently larger than the thickness t2 of the second protective layer 6B. Therefore, the expected functions of the first protective layer 6A, i.e., the insulation and protection of the heat-producing resistor 5 can be maintained, so that the life of the thermal head A can be prolonged.

When the baking temperature of the second protective layer 6B is lower than the softening temperature of the glass for forming the first protective layer 6A like the above-described method, the diffusion of the conductive component into the first protective layer 6A in the baking process for forming the second protective layer 6B is efficiently prevented, as described above. Therefore, the degradation of the sealing performance for the heat-producing resistor 5 can be prevented efficiently, which is preferable for prolonging the life of the thermal head A.

When the thickness t1 of the first protective layer 6A is small, the thermal responsiveness of the heat-producing resistor 5 relative to the printing medium is good, so that high speed printing is possible. However, the heat-producing resistor is likely to be exposed due to wearing, so that the durability is degraded. On the other hand, when the thickness t1 of the first protective layer 6A is large, the durability is enhanced. However, the thermal responsiveness of the heat-producing resistor 5 is degraded, so that the printing speed needs to be reduced or proper printing cannot be performed. Therefore, it is preferable that the thickness t1 of the first protective layer 6A is in the range of 2 to 13 μm. When the thickness t1 of the first protective layer 6A is within this range, the printing speed can be increased while keeping appropriate durability.

Since the second protective layer 6B contains a conductive component, the static electricity generated in the printing process can be discharged efficiently. The second protective layer 6B containing a conductive component has more excellent mechanical strength and wear resistance as compared with a protective layer which does not contain a conductive component. However, when the thickness t2 of the second protective layer 6B is too small, appropriate wear resistance cannot be obtained, and further, the adhesion to the first protective layer 6A is degraded. In such a case, the separation or cracking of the second protective layer 6B is likely to occur. Therefore, it is preferable that the thickness t2 of the second protective layer 6B is in the range of 0.5 to 4 μm. When the thickness t2 of the second protective layer 6B is within this range, appropriate wear resistance and adhesion to the first protective layer 6A are secured properly.

In forming the second protective layer 6B, when 0.3 to 30 wt % of ruthenium oxide particles whose particle size is 0.001 to 1 μm, for example, is added as a conductive component to the conductive glass paste, the conductive component suppresses the flow of the glass component in baking the second protective layer 6B. Therefore, traces of bubbles form around the conductive component, and the traces become pores. As a result, the second protective layer 6B becomes porous.

When the second protective layer 6B is porous, the obverse surface of the upper layer is irregular. Therefore, in the printing process, many clearances are defined between the second protective layer 6B and the printing medium, so that the adhesion therebetween is prevented. Therefore, the printing medium can be transferred smoothly, and the sticking can be reliably prevented as described before. Therefore, when the second protective layer 6B is made by utilizing crystallized glass and by the manufacturing method according to the above-described first embodiment, the second protective layer 6B is obtained as a more uniform porous layer, which is more preferable for preventing sticking.

In the present invention, the thicknesses of the first protective layer and the second protective layer are not limited to the range described in the second embodiment, and may be changed appropriately as long as the thickness of the first protective layer is not less than three times the thickness of the second protective layer. Instead of the flat glaze layer of the foregoing embodiments, a glaze layer including a bulged portion may be employed. Further, the present invention is applicable to any kind of thermal head including a thin-film type and a thick-film type.

The invention claimed is:

1. A thermal head comprising a substrate on which a heat-producing resistor, an electrode for energizing the heat-producing resistor and a protective layer having a double-layer structure and covering at least the heat-producing resistor are provided;

wherein a second protective layer constituting an upper layer of the protective layer is conductive and formed by printing and baking glass paste, wherein a first protective layer constituting a lower layer of the protective layer is formed by printing and baking glass paste and has a thickness of not less than three times a thickness of the second protective layer, and wherein a softening temperature of the second protective layer is lower than a softening temperature of the first protective layer, the second protective layer being porous.

2. The thermal head according to claim 1, wherein the thickness of the first protective layer is 2 to 13 μm, and the thickness of the second protective layer is 0.5 to 4 μm.

3. The thermal head according to claim 1, wherein the second protective layer has an irregular obverse surface.

4. The thermal head according to claim 1, wherein the first protective layer is less porous than the second protective layer.

5. The thermal head according to claim 1, wherein the softening temperature of the first protective layer is about 745° C.

6. The thermal head according to claim 1, wherein the softening temperature of the second protective layer is about 590° C.

7. The thermal head according to claim 1, wherein the second protective layer contains a conductive component.

8. The thermal head according to claim 1, wherein a baking temperature of the second protective layer is higher than the softening temperature of the second protective layer and lower than the softening temperature of the first protective layer.

9. A method for manufacturing the thermal head as set forth in claim 1, wherein the first protective layer is formed by baking glass, whereas the second protective layer is formed by baking glass containing a conductive component added thereto at a baking temperature which is lower than a softening temperature of the glass of the first protective layer.

10. A method for manufacturing the thermal head as set forth in claim 1, wherein the first protective layer is formed by baking amorphous glass, whereas the second protective layer is formed by baking crystallized glass containing a conductive component added thereto at a baking temperature which lies in a range of 30 degrees lower and 50 degrees higher than a softening temperature of the crystallized glass.

11. The thermal head manufacturing method according to claim 10, wherein softening temperature of the amorphous glass for forming the first protective layer is lower than the baking temperature of the second protective layer by not less than 50 degrees.

12. The thermal head manufacturing method according to claim 11, wherein the softening temperature of the amorphous glass for forming the first protective layer is lower than the softening temperature of the crystallized glass by not less than 50 degrees.

13. The thermal head manufacturing method according to claim 11, wherein the baking temperature of the first protective layer is substantially equal to the baking temperature of the second protective layer.

14. A thermal head comprising a substrate on which a heat-producing resistor, an electrode for energizing the heat-producing resistor and a protective layer having a double-layer structure and covering at least the heat-producing resistor are provided, the protective layer being made up of a first protective layer as a lower layer and a second protective layer as an upper layer;

wherein the first protective layer is made of amorphous glass in a manner such that bubbles contained in the amorphous glass are caused to disappear, and wherein the second protective layer is made of crystallized glass in a manner such that the second protective layer is porous and has an irregular obverse surface.

15. The thermal head according to claim 14, wherein a softening temperature of the first protective layer is about 680° C.

16. The thermal head according to claim 14, wherein a softening temperature of the second protective layer is about 785° C.

* * * * *

UNITED STATES PATENT AND TRADEMARK OFFICE

CERTIFICATE OF CORRECTION

PATENT NO. : 8,009,185 B2
APPLICATION NO. : 11/629581
DATED : August 30, 2011
INVENTOR(S) : Teruhisa Sako It is certified that error appears in the above-identified patent and that said Letters Patent is hereby corrected as shown below:

Title page, the following should be added:

(30) Foreign Application Priority Data
June 15, 2004 (JP).....2004-176488
June 15, 2004 (JP).....2004-176489

Signed and Sealed this
Tenth Day of January, 2012

David J. Kappos

David J. Kappos
*Director of the United States Patent and Trademark Office*